US009541077B2

(12) United States Patent
Kim

(10) Patent No.: US 9,541,077 B2
(45) Date of Patent: Jan. 10, 2017

(54) HERMETIC COMPRESSOR

(75) Inventor: Yong Yeoun Kim, Gwangiu (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 398 days.

(21) Appl. No.: 13/521,100

(22) PCT Filed: Nov. 5, 2010

(86) PCT No.: PCT/KR2010/007808
§ 371 (c)(1),
(2), (4) Date: Nov. 8, 2012

(87) PCT Pub. No.: WO2011/083906
PCT Pub. Date: Jul. 14, 2011

(65) Prior Publication Data

US 2013/0052056 A1 Feb. 28, 2013

(30) Foreign Application Priority Data

Jan. 8, 2010 (KR) ..... 10-2010-0001653

(51) Int. Cl.
*F04B 35/04* (2006.01)
*F04B 39/00* (2006.01)
(Continued)

(52) U.S. Cl.
CPC ..... *F04B 35/04* (2013.01); *F04B 39/0022* (2013.01); *F04B 39/121* (2013.01); *F04B 39/14* (2013.01)

(58) Field of Classification Search
CPC ..... F04B 35/04; F04B 39/04; F04B 39/14; F04D 29/047; F04D 29/046
(Continued)

(56) References Cited

U.S. PATENT DOCUMENTS 4,540,906 A * 9/1985 Blom ..... 310/67 R
4,682,065 A * 7/1987 English et al. ..... 310/90
(Continued)

FOREIGN PATENT DOCUMENTS

CN 101334019 12/2008
JP 2002-021733 1/2002
(Continued)

OTHER PUBLICATIONS

U.S. Appl. No. 13/521,100 Sep. 9, 2014 JP 2006242164 A I w English Translation (JP-2006242164 with English Machine Translation).*
(Continued)

*Primary Examiner* — Devon Kramer
*Assistant Examiner* — Kenneth J Hansen
(74) *Attorney, Agent, or Firm* — Staas & Halsey LLP

(57) ABSTRACT

A hermetic compressor including a compression unit for compressing a refrigerant is disclosed. The compressor includes motor for providing a compression driving force of the refrigerant, a frame on which the compression unit and the motor are installed, a rotation shaft for transferring the driving force of the motor to the compression unit, and a journal bearing disposed on the frame such that the rotation shaft passes therethrough to rotatably support the rotation shaft. The motor includes a stator fixed to an outside of the journal bearing and including a stator core, and a rotor including a body disposed outside the stator and rotatably installed such that the rotor rotates together with the rotation shaft by electromagnetic interaction with the stator, the stator core is coupled to a fastening member to prevent the relative rotation thereof with respect to the journal bearing. The fastening member fixes the stator core such that it is not moved in an axial direction and is coupled to the journal bearing to enable the stator and the rotor to be easily
(Continued)

installed while the rotor of the motor is disposed outside the stator.

4 Claims, 4 Drawing Sheets

(51) Int. Cl.
*F04B 39/12* (2006.01)
*F04B 39/14* (2006.01)

(58) Field of Classification Search
USPC ..... 417/423.7, 365, 423.12, 410.3, 415; 384/129, 226, 275; 310/67 R, 90
See application file for complete search history.

(56) References Cited

U.S. PATENT DOCUMENTS 5,118,263 A * 6/1992 Fritchman ..... 417/415
5,166,565 A * 11/1992 Katsuzawa et al. ..... 310/90
5,363,003 A * 11/1994 Harada ..... H02K 1/187 310/216.118
6,204,583 B1 * 3/2001 Sasaki et al. ..... 310/91
6,882,074 B2 * 4/2005 Horng et al. ..... 310/90
2006/0182644 A1 8/2006 Delpassand et al.

FOREIGN PATENT DOCUMENTS

JP 2004-082039 3/2004
JP 2006226273 8/2006
JP 2006-242164 9/2006
JP 2007-295714 11/2007
JP 2007-321703 12/2007
WO WO2008/082251 7/2008

OTHER PUBLICATIONS

International Search Report, mailed Jun. 24, 2011, in corresponding International Application No. PCT/KR2010/007808 (5 pp.).
Office Action, dated Jul. 22, 2014, in corresponding Chinese Application No. 20108006515.0.
Korean Office Action dated Apr. 20, 2016 from Korean Patent Application No. 10-2010-0001653, 8 pages.
Korean Office Action dated Oct. 27, 2016 from Korean Patent Application No. 10-2010-0001653, 3 pages.

* cited by examiner

HERMETIC COMPRESSOR

TECHNICAL FIELD

The disclosure relates to a hermetic compressor. More particularly, the disclosure relates to a hermetic compressor, in which a rotor of a motor is disposed outside a stator to improve the compression efficiency and to reduce an amount of coils wound around a stator core.

BACKGROUND ART

In general, a hermetic compressor is employed in a cooling cycle of a refrigerator or an air conditioner to compress a refrigerant and includes a compression unit for compressing the refrigerant and a motor for providing a compression driving force of the refrigerant. The hermetic compressor including the compression unit and the motor is accommodated in a hermetic case.

The compression unit may include a piston that compresses the refrigerant through the linear reciprocation movement. In addition, the motor generally includes a stator and a rotor rotated through the electromagnetic interaction with the stator as current is applied to the stator.

A frame is installed in the hermetic case to install the compression unit and the motor thereon. Typically, the rotor is rotatably supported by a journal bearing installed at an inner upper portion of the frame, and the stator is fixed to an upper outer portion of the frame while surrounding the rotor.

The driving force of the motor is transferred to the compression unit through a rotation shaft. One end of the rotation shaft is press-fitted into the center of the rotor to rotate together with the rotor and the other end of the rotation shaft extends to the lower portion of the frame while rotatably passing through the journal bearing.

An eccentric shaft is provided at an end of the rotation shaft extending to the lower portion of the frame such that the eccentric shaft is eccentrically rotated as the rotation shaft is rotated, and a connecting rod is installed between the eccentric shaft and the piston in order to convert the eccentric rotational movement of the eccentric shaft into the linear reciprocation movement of the piston. Thus, the driving force of the motor is transferred to the compression unit through the rotation shaft.

However, the conventional hermetic compressor has the following problems.

That is, in the conventional hermetic compressor, in which the rotor is provided in the stator, a diameter of the rotor that rotates together with the rotation shaft is smaller than that of the stator, so the rotor may not generate high torque.

In addition, in the conventional hermetic compressor, in which the size of the stator provided outside the rotor is larger than the size of the rotor, the amount of coils wound around the stator is increased, so it is not economic in terms of the usage of materials.

Therefore, recently, there have been attempts to provide a hermetic compressor employing a motor, in which a rotor is installed outside a stator to increase a diameter of the rotor and to reduce the amount of coils wound around the stator.

DISCLOSURE

Technical Problem

However, a new installation structure for a stator and a rotor is necessary in order to install the rotor outside the stator. Until now, there has not been developed a hermetic compressor, in which a rotor is installed outside a stator and the installation work for the rotor and the stator is simplified.

The disclosure is made to solve the above problem occurring in the prior art, and an object of the disclosure is to provide a hermetic compressor, in which a rotor of a motor is installed outside a stator and the installation work for the rotor and the stator is simplified.

Technical Solution

In order to accomplish the above object, a hermetic compressor according to the disclosure includes a compression unit for compressing a refrigerant, a motor for providing a compression driving force of the refrigerant, a frame on which the compression unit and the motor are installed, a rotation shaft for transferring the driving force of the motor to the compression unit, and a journal bearing disposed on the frame such that the rotation shaft passes therethrough to rotatably support the rotation shaft, wherein the motor includes a stator fixed to an outside of the journal bearing and including a stator core, and a rotor including a body disposed outside the stator and rotatably installed such that the rotor rotates together with the rotation shaft by electromagnetic interaction with the stator, the stator core is coupled to a fixing member such that the stator core is prevented from rotating relative to the journal bearing, and wherein the fixing member is fastened to the journal bearing to fix the stator core in a state in which the stator core is prevented from moving in an axial direction.

A through hole is formed at a center of the stator core, the stator core is coupled with the journal bearing in an axial direction of the journal bearing such that at least a part of the journal bearing is inserted into the through hole, a sliding tolerance is formed between an outer peripheral portion of the journal bearing inserted into the through hole and an inner peripheral portion of the through hole, an anti-rotation groove is formed in one of the outer peripheral portion of the journal bearing and the inner peripheral portion of the through hole, and an anti-rotation protrusion inserted into the anti-rotation groove is formed at remaining one of the outer peripheral portion of the journal bearing and the inner peripheral portion of the through hole in such a manner that a sliding action of the stator core coupled with the journal bearing is ensured while preventing a relative rotation between the stator core and the journal bearing in a state that the stator core is slidably coupled with the journal bearing.

A through hole is formed at a center of the stator core, the stator core is coupled with the journal bearing in an axial direction of the journal bearing such that at least a part of the journal bearing is inserted into the through hole, a sliding tolerance is formed between an outer peripheral portion of the journal bearing inserted into the through hole and an inner peripheral portion of the through hole, the fixing member is prepared in a form of an open ring having both ends spaced part from each other to allow the fixing member to have elasticity, a fastening groove is formed in the outer peripheral portion of the journal bearing in a circumferential direction of the journal bearing to fasten the fixing member, a support protrusion is provided at the through hole, and the support protrusion is supported while being locked with the fixing member fastened to the fasting groove.

The stator core is coupled with the journal bearing from a top of the journal bearing, the through hole includes a small-diameter section formed at a lower portion of the through hole to support an outer surface of the journal bearing with a predetermined tolerance and a large-diameter section formed at an upper portion of the small-diameter section and having an inner diameter larger than an inner diameter of the small-diameter section, an upper end of the journal bearing passes through the small-diameter section, the support protrusion is provided at an upper end of the small-diameter section, and the fastening groove is formed at the outer peripheral portion of the journal bearing corresponding to a lower end of the large-diameter section such that the support protrusion is supported while being locked with the fixing member.

Advantageous Effects

As described above, according to the hermetic compressor of the disclosure, the rotor can be installed outside the stator and the stator inside the rotor can be simply fixed to the journal bearing by using the simple structure, such as the anti-rotation protrusion, the anti-rotation groove and the fixing member.

Therefore, the hermetic compressor according to the disclosure can increase the torque of the rotor while reducing the amount of coils wound around the stator core. In addition, the motor having the modified structure can be simply installed on the frame.

BEST MODE

Mode for Invention

Figure 1:
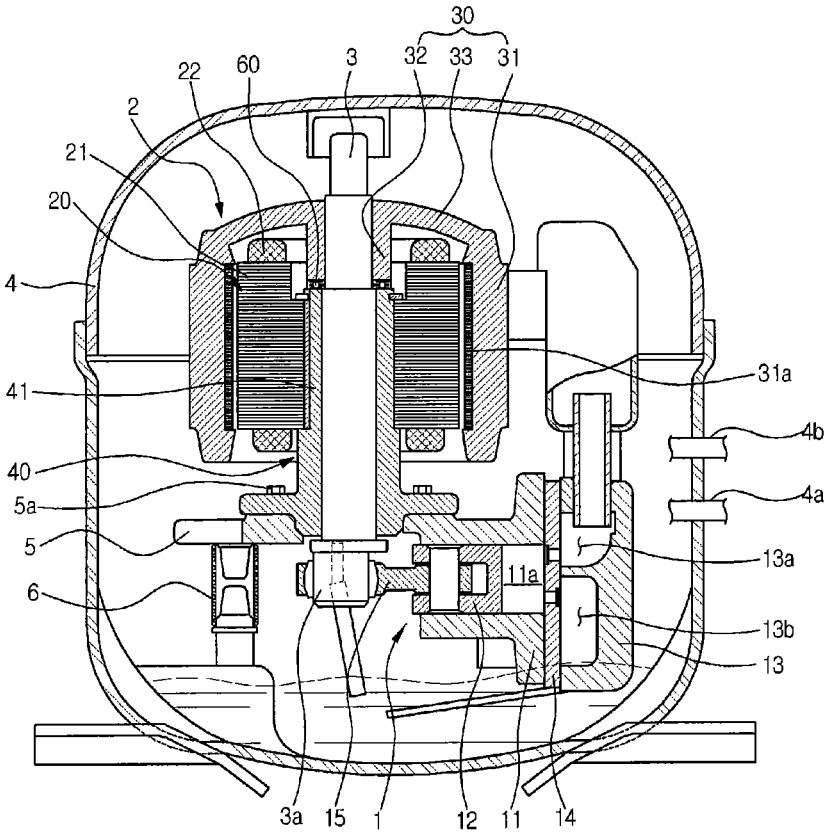
FIG. 1 is a sectional view showing the structure of a hermetic compressor according to an exemplary embodiment of the disclosure.

Hereinafter, the structure of a hermetic compressor according to the exemplary embodiments of the disclosure will be described in detail with reference to accompanying drawings.

As shown in FIGS. 1 to 6, the hermetic compressor according to the exemplary embodiment of the disclosure includes a compression unit 1 for compressing a refrigerant, a motor 2 for providing a compression driving force of the refrigerant, and a rotation shaft 3 for transferring a driving force of the motor 2 to the compression unit 1.

These components of the hermetic compressor are accommodated in a hermetic case 4 forming an outer appearance of the hermetic compressor, in which the compression unit 1 and the motor 2 are installed through a frame 5 provided in the hermetic case 4.

Connected to the hermetic case 4 are a suction guide pipe 4*a* for guiding the refrigerant, which has passed through an evaporator of a cooling cycle, to the hermetic case 4 and an exhaust guide pipe 4*b* for guiding the refrigerant, which has been compressed in the hermetic case 4, to a condenser of the cooling cycle. The frame 5 is fixed while being elastically supported in the hermetic case 4 by a buffer device 6 installed between the frame 5 and the bottom of the hermetic case 4.

In detail, the compression unit 1 includes a cylinder 11 integrally formed with a lower portion of the frame 5 to form a compression chamber 11*a*, a piston 12 installed in the compression chamber 11*a* to linearly reciprocate in the compression chamber 11*a*, and a cylinder head 13 coupled to one end of the cylinder 11 to seal the compression chamber 11*a*. The cylinder head 13 includes a refrigerant suction chamber 13*a* and a refrigerant exhaust chamber 13*b*, which are separated from each other. The refrigerant suction chamber 13*a* guides the refrigerant into the compression chamber 11*a* in cooperation with the suction guide pipe 4*a*, and the refrigerant exhaust chamber 13*b* guides the refrigerant, which has been compressed in the compression chamber 11*a*, into the exhaust guide pie 4*b* in cooperation with the exhaust guide pipe 4*b*. In addition, a valve device 14 is provided between the cylinder head 13 and the cylinder 11 in order to control the flow of the refrigerant, which is introduced from the refrigerant suction chamber 13*a* to the compression chamber 11*a* or exhausted from compression chamber 11*a* to the refrigerant exhaust chamber 13*b*.

In addition, the motor 2 includes a stator 20 and a rotor 30, which is rotated through the electromagnetic interaction with the stator 20. The stator 20 includes a stator core 21 and a coil 22 wound around the stator core 21. As power is applied to the coil 22, the rotor 30 is rotated through the electromagnetic interaction between the rotor 30 and the stator 20.

The rotation shaft 3 extends by passing through the frame 5. A lower end of the rotation shaft 3 adjacent to the lower portion of the frame 5 is provided with an eccentric shaft 3*a*, which is eccentrically rotated as the rotation shaft 3 is rotated, in order to transfer the rotational movement of the rotation shaft 3 to the compression unit 1. In addition, a connecting rod 15 is connected between the eccentric shaft 3*a* and the piston 12 in order to convert the eccentric rotational movement of the eccentric shaft 3*a* into the linear reciprocation movement of the piston 12.

Therefore, according to the hermetic compressor of the disclosure, when the rotation shaft 3 is rotated by the driving force of the motor 2, the piston 12 linearly reciprocates in the compression chamber 11*a* to compress the refrigerant.

Meanwhile, in the hermetic compressor according to the disclosure, the rotor 30 of the motor 2 includes a body 31 disposed outside the stator 20 while surrounding the stator 20.

In this manner, the diameter of the rotor 30 may be larger than the diameter of the stator 20 due to the body 31, so the rotor 30 can effectively generate high torque and the amount of coils 22 wound around the stator core 21 can be reduced.

In addition, the hermetic compressor according to the disclosure further includes a structure for simply installing the motor 2 having the structure, in which the rotor 30 is disposed outside the stator 20, on the frame 5. Hereinafter, the structure for simply installing the motor 2 on the frame 5 will be described in detail.

Figure 2:
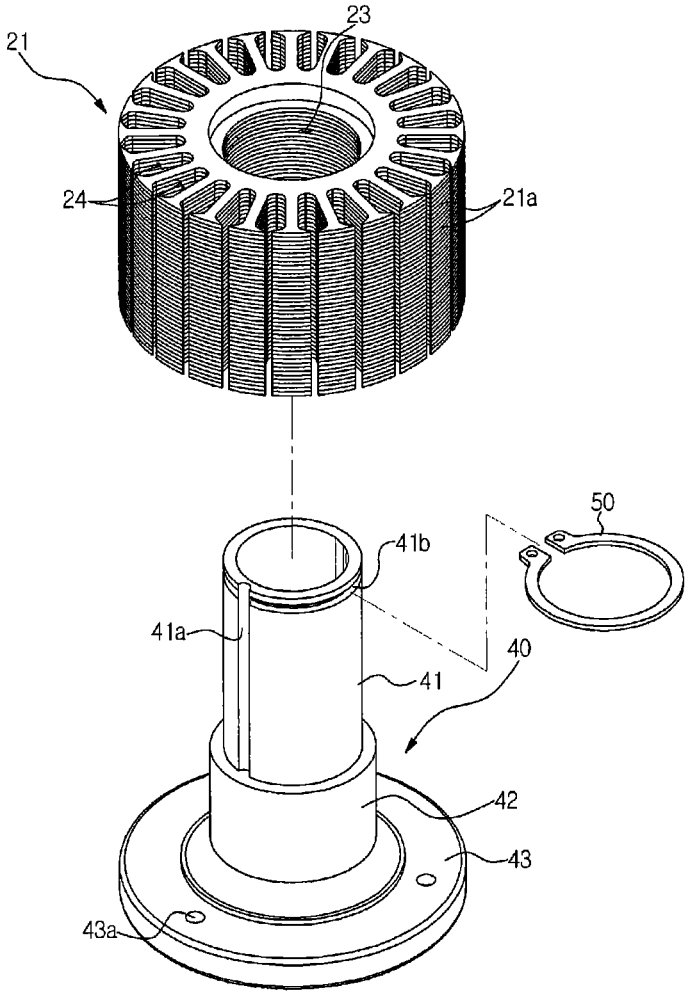
FIG. 2 is an exploded perspective view showing a journal bearing and a stator core of a hermetic compressor according to an exemplary embodiment of the disclosure.
Figure 3:
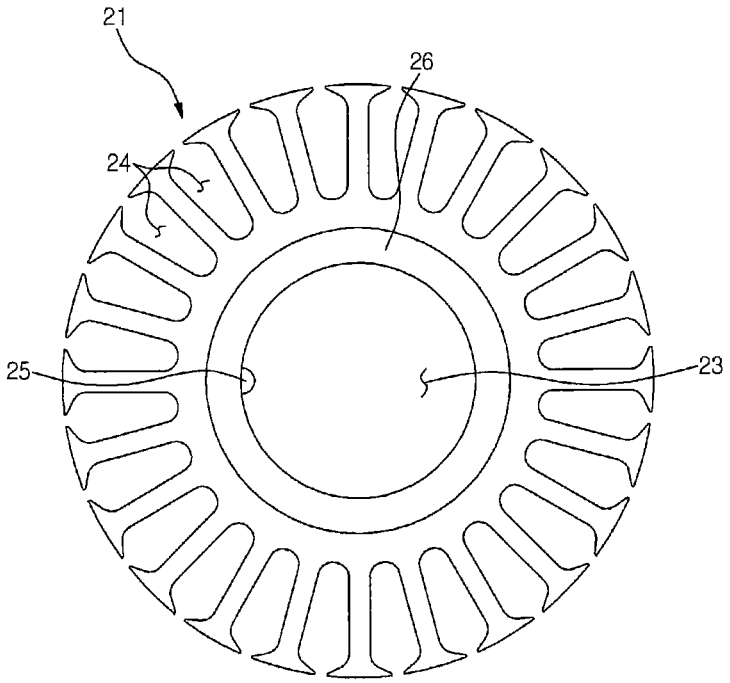
FIG. 3 is a plan view showing a stator core of a hermetic compressor according to an exemplary embodiment of the disclosure.

Referring to FIGS. 2 and 3, a journal bearing 40 is installed at an upper portion of the center of the frame 5 in order to rotatably support the rotation shaft 3 extending by passing through the center of the frame 5. The journal bearing 40 has a hollow cylindrical structure.

The journal bearing 40 is divided into an insertion part 41, which is formed at an upper portion of the journal bearing 40 and inserted into a through hole 23 formed at the center of the stator core 21 so as to be coupled with the stator core 21, and a support part 42 formed at a lower portion of the insertion part 41 and having an outer diameter larger than that of the insertion part 41 to support the lower end of the stator core 21.

Thus, an inner diameter of the journal bearing 40 is configured to have a predetermined size lengthwise along the rotation shaft 3 to rotatably support the rotation shaft 3, and the outer diameter of the journal bearing 40 is configured such that the outer diameter of the support part 42 is larger than that of the insertion part 41.

The journal bearing 40 is fixed to the frame 5 by a bolt 51 fastened to an extension part 43 radially extending around the lower portion of the support part 42. Reference number 43*a* represents a fastening hole to fasten the bolt 5*a*.

In addition, the stator core 21 can be prepared by stacking a plurality of electric steel plates 20*a* and the through hole 23 is formed at the center of the stator 21 in order to allow the stator core 21 to be fitted around the insertion part 41 of the journal bearing 40.

The through hole 23 includes a small-diameter section 23A, which is formed at a lower portion of the through hole 23 to support an outer surface of the insertion part 41 of the journal bearing 40 with a predetermined sliding tolerance, and a large-diameter section 23B, which is formed at an upper portion of the small-diameter section 23A with an inner diameter larger than that of the small-diameter section 23A. In addition, a plurality of slots 24 are radially formed on the outer surface of the stator core 21 around the through hole 23 in order to wind the coil 22. Each slot 24 is open outward of the stator core 21 to facilitate the winding work for the coil 22.

Thus, the stator 20 is fitted around the insertion part 41 of the journal baring 40 through the through hole 23 from the upper portion of the journal baring 40. At this time, due to the sliding tolerance formed between the inner diameter of the through hole 23 adjacent to the small-diameter section 23A and an outer diameter of the journal bearing 40 adjacent to the insertion part 41, the stator 20 can be easily fitted around the insertion part 41 without causing damage to the to the through hole 23 of the stator core 21 and the insertion part 41 of the journal bearing 40. In a state in which the stator core 21 is fitted around the insertion part 41, the lower end of the stator core 21 is supported on an upper end of the support part 42 and the length of the insertion part 41 is shorter than the length of the stator core 21.

In addition, the stator 20 must be fixed to the frame 5. However, if the stator core 21 is fitted around the insertion part 41 of the journal bearing 40 through the through hole 23, the stator core 21 may rotate with respect to the journal bearing 40, so it is necessary to prevent the stator core 21 from rotating relative to the journal bearing 40.

To this end, according to the present embodiment, an anti-rotation grove 41*a* is formed at an outer peripheral portion of the insertion part 41 of the journal bearing 40 and an anti-rotation protrusion 25 coupled with the anti-rotation grove 41*a* is provided at the stator core 21 adjacent to an inner peripheral portion of the small-diameter section 23A.

The anti-rotation protrusion 25 extends in the axial direction of the rotation shaft 3 to protrude from the inner peripheral portion of the small-diameter section 23A to the center of the through hole 23 and the anti-rotation grove 41*a* is formed at the outer peripheral portion of the insertion part 41 in the axial direction of the rotation shaft 3. The sliding tolerance is formed between the anti-rotation protrusion 25 and the anti-rotation grove 41*a* to allow the sliding action of the stator core 21 coupled with the journal bearing 40.

Thus, when the small-diameter section 23A of the through hole 21 of the stator core 21 is slidably fitted around the insertion part 41 of the journal bearing 40, the anti-rotation protrusion 25 is slidably coupled with the anti-rotation grove 41*a*. In this state, the anti-rotation protrusion 25 is locked with the anti-rotation grove 41*a*, so the stator core 21 can be prevented from moving relative to the journal bearing 40.

Different from the present embodiment, the anti-rotation grove 41*a* can be formed at the stator core 21 and the anti-rotation protrusion 25 can be formed at the journal bearing 40. That is, the position and the configuration of the anti-rotation grove 41*a* and the anti-rotation protrusion 25 can be variously modified to the extent that the sliding action of the stator core 21 coupled to the journal bearing 40 can be ensured while preventing the relative rotation between the stator core 21 and the journal bearing 40 in a state that the stator core 21 has been slidably coupled to the journal bearing 40.

Figure 4:
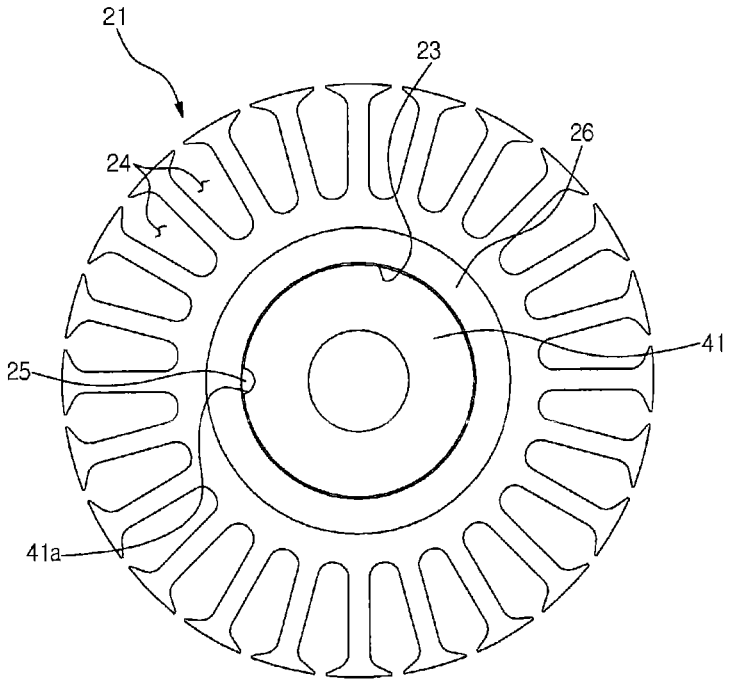
FIG. 4 is a plan view showing a stator core fitted in a journal bearing of a hermetic compressor according to an exemplary embodiment of the disclosure.
Figure 5:
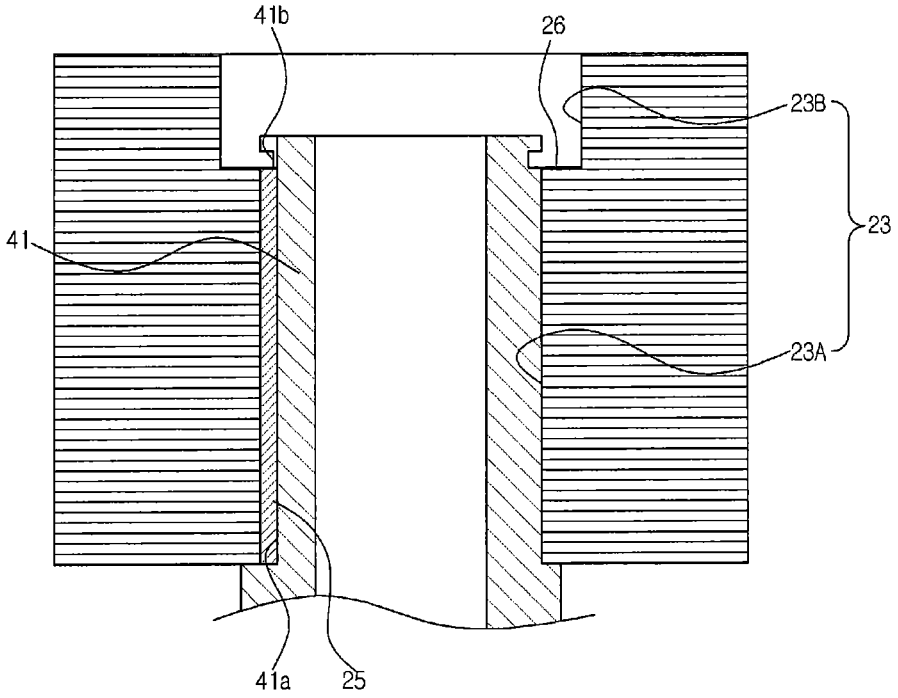
FIG. 5 is a side sectional view showing a stator core fitted in a journal bearing of a hermetic compressor according to an exemplary embodiment of the disclosure.

FIGS. 4 and 5 show the coupling structure between the anti-rotation protrusion 25 and the anti-rotation grove 41*a*. In this state, the relative rotation between the stator core 21 and the journal bearing 40 can be prevented, but the stator core 21 may move upward in the axial direction of the journal bearing 40.

Figure 6:
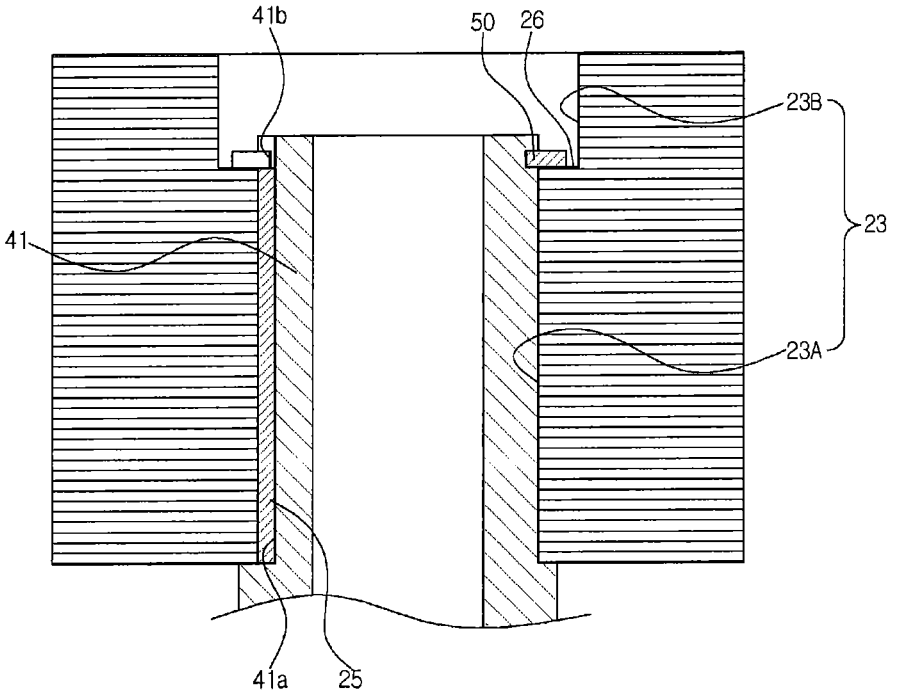
FIG. 6 is a side sectional view showing a fixing member coupled to a journal bearing in a state of FIG. 5.

Therefore, as shown in FIG. 6, according to the present embodiment, a fixing member 50 is fastened to the journal bearing 40 in order to prevent the stator core 21 from moving in the axial direction.

The fixing member 50 is prepared in the form of an open ring having a C-shape, in which both ends of the open ring are spaced apart from each other to allow the fixing member to have elasticity. A fastening groove 41*b* is formed at an outer peripheral portion of the journal bearing 40 in the circumferential direction in order to fasten the fixing member 50. In order to allow the fixing member 50 to be elastically fastened into the fastening groove 41*b*, an inner diameter of the fixing member 50 is set to be smaller than an outer diameter of the insertion part 41 when there is no external force. In addition, an upper end of the small-diameter section 23A, which corresponds to a boundary between the large-diameter section 23B and the small-diameter section 23A, is provided with a support protrusion 26 that is supported while being locked with the fixing member 50 fastened into the fastening groove 41*b*.

As shown in the drawings, in a state that the stator core 21 is fitted around the insertion part 41 of the journal bearing 40, an upper end of the insertion part 41 of the journal bearing 40 passes through the small-diameter section 23A of the through hole 23. At this time, in order to allow the support protrusion 26 to be supported while being locked with the fixing member 50, the fastening groove 41*b* is formed at the outer peripheral portion of the insertion part 41 of the journal bearing 40 corresponding to the lower end of the large-diameter section 23B of the through hole 23 such that the fastening groove 41*b* may intersect with the anti-rotation groove 41*a*.

Therefore, as shown in FIGS. 4 and 5, when the anti-rotation protrusion 25 has been coupled into the anti-rotation groove 41*a* in a state that the stator core 21 is fitted around the insertion part 41 of the journal bearing 40, if the fixing member 50 is fastened to the fastening groove 41*b* by widening both ends of the fixing member 50 after inserting the fixing member 50 into the large-diameter section 23B from the top of the stator core 21, as shown in FIG. 6, the support protrusion 26 is supported on the fixing member 50 fastened to the fastening groove 41*b* while being locked with the fixing member 50, so that the stator core 21 can be prevented from moving relative to the journal bearing 40 and can be prevented from moving in the axial direction. Thus, the stator core 21 can be stably fixed to the journal bearing 40.

At this time, in order to ensure the working space for fastening the fixing member 50, preferably, the inner diameter of the of the large-diameter section 23B is larger than the outer diameter of the fixing member 50 which has been widened to be larger than the outer diameter of the insertion part 41.

In addition, in a state that the stator 20 has been fixed to the journal bearing 40, the rotation shaft 3 is fitted into the journal bearing 40 and then the rotor 30 is installed.

Referring again to FIG. 1, the rotor 30 includes the body 31 provided outside the stator 20, a shaft coupling part 32 coupled to an outer surface of the rotation shaft 3 adjacent to the upper portion of the journal bearing 40 to allow the rotor 30 to rotate together with the rotation shaft 3, and a connection part 33 for connecting the body 31 to the shaft coupling part 32.

The body 31 has a cylindrical structure with an inner diameter larger than an outer diameter of the stator 20 and is disposed outside the stator 20. In addition, an aluminum bar 31*a* is installed inside the body 31 to allow the induction current to smoothly flow from the stator 0. A predetermined gap is formed between the aluminum bar 31*a* and the outer diameter section of the stator 20.

The shaft coupling part 32 has a cylindrical structure. The inner diameter section of the shaft coupling part 32 is press-fitted around the outer diameter section of the rotation shaft 3 adjacent to the upper portion of the journal bearing 40 in such a manner that the lower portion of the shaft coupling part 32 can be introduced into the large-diameter section 23B of the through hole 23. The connection part 33 integrally connects the upper end of the body 31 with the upper end of the shaft coupling part 32 to prevent the rotor 30 from interfering with the stator 20 when the rotor 30 rotates.

In order to prevent the outer diameter section of the shaft coupling part 32 from interfering with the inner diameter section of the large-diameter section 23B of the through hole 23 when the shaft coupling part 32 is press-fitted around the rotation shaft 3 or when the rotor 30 rotates, preferably, the outer diameter of the shaft coupling part 32 is smaller than the inner diameter of the large-diameter section 23B.

Due to the above structure, as the shaft coupling part 32 is press-fitted around the rotation shaft 3, the rotor 30 is fixed to the rotation shaft 3 in such a manner that the body 31 can be positioned outside the stator 20. In this state, the load of the rotor 30 and the rotation shaft 3 can be transferred to the journal bearing 40 through the shaft coupling part 32. Thus, when the rotor 30 rotates together with the rotation shaft 3, excessive friction may occur between the shaft coupling part 32 and the upper end of the insertion part 41 of the journal bearing 40, so that the rotor 30 may not smoothly rotate. To solve this problem, preferably, a bearing member 60 is installed around the rotation shaft 3 between the shaft coupling part 32 and the insertion part 41 of the journal bearing 40 in order to suppress the friction between the shaft coupling part 32 and the insertion part 41 when the rotation shaft 3 rotates.

Therefore, the hermetic compressor having the above structure according to the present embodiment can increase the torque of the rotor 30 and can reduce the amount of coils 22 wound around the stator 20. In addition, although the position of the stator 20 and the rotor 30 of the motor 2 may be changed as compared with the related art, the motor 2 can be simply installed on the frame 5 and the rotor 30 can be smoothly rotated.

The invention claimed is:

1. A hermetic compressor comprising:

a compression unit for compressing a refrigerant;

a motor for providing a compression driving force of the refrigerant;

a frame on which the compression unit and the motor are installed;

a rotation shaft for transferring the driving force of the motor to the compression unit;

a journal bearing fixed to the frame such that the rotation shaft passes therethrough to rotatably support the rotation shaft; and a bearing member installed around the rotation shaft between the motor and the journal bearing, wherein the motor includes a stator fixed to an outside of the journal bearing, and a rotor having a body disposed outside the stator and rotatably installed such that the rotor rotates together with the rotation shaft by electromagnetic interaction with the stator, wherein the stator includes a stator core detachably coupled to the journal bearing, wherein the stator core is prevented from rotating relative to the journal bearing, wherein a through hole is formed at a center of the stator core and the stator core is coupled with the journal bearing in an axial direction of the journal bearing, wherein the through hole includes a small-diameter section formed at a lower portion of the through hole to support an outer surface of the journal bearing and a large-diameter section formed at an upper portion of the small-diameter section, wherein an inner diameter of the large-diameter section is larger than an inner diameter of the small-diameter section, wherein an upper end of the journal bearing passes through the small-diameter section, wherein the stator core is prevented from moving in an axial direction by a coupling point within a space created by the large-diameter section, wherein the stator core is formed by stacking a plurality of electric steel plates, and wherein the plurality of electric steel plates are stacked at the small-diameter section and the large-diameter section.

2. The hermetic compressor of claim 1, wherein the stator is prevented from rotating relative to the journal bearing by an anti-rotation groove on the journal bearing, and wherein the stator core is coupled with the journal bearing in an axial direction of the journal bearing such that at least a part of the journal bearing is inserted into the through hole, a sliding tolerance is formed between an outer peripheral portion of the journal bearing inserted into the through hole and an inner peripheral portion of the through hole, the anti-rotation groove is formed in one of the outer peripheral portion of the journal bearing and the inner peripheral portion of the through hole, and an anti-rotation protrusion inserted into the anti-rotation groove is formed at remaining one of the outer peripheral portion of the journal bearing and the inner peripheral portion of the through hole in such a manner that a sliding action of the stator core coupled with the journal bearing is ensured while preventing a relative rotation between the stator core and the journal bearing in a state that the stator core is slidably coupled with the journal bearing.

3. The hermetic compressor of claim 1, wherein the stator core is prevented from moving in the axial direction by a fastening member coupled to the journal bearing at the coupling point, and wherein the stator core is coupled with the journal bearing in an axial direction of the journal bearing such that at least a part of the journal bearing is inserted into the through hole, a sliding tolerance is formed between an outer peripheral portion of the journal bearing inserted into the through hole and an inner peripheral portion of the through hole, the fastening member is prepared in a form of an open ring having both ends spaced part from each other to allow the fastening member to have elasticity, a fastening groove is formed in the outer peripheral portion of the journal bearing in a circumferential direction of the journal bearing to fasten the fastening member, a support protrusion is provided at the through hole, and the support protrusion is supported while being locked with the fastening member fastened to the fastening groove.

4. The hermetic compressor of claim 3, wherein the small-diameter section supports an outer surface of the journal bearing with a predetermined tolerance, the support protrusion is provided at an upper end of the small-diameter section, and the fastening groove is formed at the outer peripheral portion of the journal bearing corresponding to a lower end of the large-diameter section such that the support protrusion is supported while being locked with the fastening member.

* * * * *